US006726041B2

(12) United States Patent
Dunn

(10) Patent No.: US 6,726,041 B2
(45) Date of Patent: Apr. 27, 2004

(54) METAL SHIPPING CRATE

(75) Inventor: Larry W. Dunn, Anderson, SC (US)

(73) Assignee: Dunn-Right Incorporated, Anderson, SC (US)

( * ) Notice: Subject to any disclaimer, the term of this patent is extended or adjusted under 35 U.S.C. 154(b) by 126 days.

(21) Appl. No.: 10/071,256

(22) Filed: Feb. 8, 2002

(65) Prior Publication Data

US 2003/0150757 A1 Aug. 14, 2003

(51) Int. Cl.[7] ..... A47F 7/00

(52) U.S. Cl. ..... 211/194; 211/189; 410/3; 206/335

(58) Field of Search ..... 211/189, 85.8, 211/194; 410/4, 23, 2, 3; 206/335; 108/55.1, 56.3

(56) References Cited

U.S. PATENT DOCUMENTS 2,579,685 A * 12/1951 Loose
3,583,581 A * 6/1971 Myers
3,848,747 A * 11/1974 Thompson
3,850,295 A * 11/1974 Black
4,703,702 A * 11/1987 Speicher ..... 211/194 X
4,756,413 A 7/1988 Gits
4,773,547 A * 9/1988 Bell ..... 211/194
4,804,087 A * 2/1989 Smith ..... 206/335
4,852,756 A 8/1989 Holladay
4,938,350 A 7/1990 Grigsby
5,413,224 A * 5/1995 Marron et al. ..... 206/335 X
5,593,058 A 1/1997 Spencer et al.
5,593,259 A * 1/1997 Kuo ..... 410/3
5,626,231 A 5/1997 Kwong et al.
5,671,854 A * 9/1997 Thomas
5,720,403 A 2/1998 Sawyer
5,743,421 A 4/1998 Gonzalez et al.
6,186,345 B1 2/2001 Robertson
6,270,007 B1 8/2001 Jensen, Jr.
6,286,792 B1 * 9/2001 Best

* cited by examiner

*Primary Examiner*—Robert W. Gibson, Jr.
(74) *Attorney, Agent, or Firm*—Charles L. Schwab; Nexsen Pruet, LLC

(57) ABSTRACT

A metal shipping crate is provided with a tubular steel construction. The crate is modifiable and expandable to enclose varying sizes of cargo. The crate requires no tools to pack and unpack, and is stackable and economical to use and store.

15 Claims, 3 Drawing Sheets

METAL SHIPPING CRATE

FIELD OF THE INVENTION

The present invention generally relates to a shipping crate and more particularly to such a shipping crate made of tubular steel rails and is easily adjustable to varying sizes.

BACKGROUND OF THE INVENTION

When shipping manufactured articles, it is a common practice to enclose the articles in some sort of packaging. This is done for several reasons, the most common being protection of the contents. During transit, cargo left unprotected would be subject to damage from other items being transported in the same vehicle, or from being dropped. Cargo is also enclosed in square or rectangular packages to ease stacking and maximize the amount of cargo that can be hauled.

These reasons for packaging are especially relevant to large articles, such as "All-terrain vehicles" (ATVs) and personal watercraft such as Jet-Skis. These items are quite heavy and of such a shape to make stacking impossible. The items are also expensive and their appearance is paramount. Therefore, it is desirable to package these types of items so as to protect them from damage during transport and allow the items to be stacked and placed adjacent to each other with a minimal amount of space between them, so as to maximize the amount of items shipped and to minimize the shifting of such heavy cargo during the shipping process.

Wooden crates for shipping such items are known in the art, and are the most prevalent means of encasing large items such as ATVs and personal watercraft. U.S. Pat. No. 5,720,403 issued to Sawyer on Feb. 24, 1998 discloses a generally rectangular shipping crate formed from plywood panels. Other wooden shipping containers are known in the art, and are used for their overall ability to protect contents and the ready availability of the raw materials needed to manufacture wooden crates.

These containers and crates have several shortcomings. They are not adjustable so as to accommodate differing sizes of cargo. Once a crate is made of a certain size, it cannot be adjusted. Wooden crates are difficult to pack and unpack. Often, glue or nails are used to seal the crate. This can result in dangerous conditions for the workers packing the crate, as glue is easily spilled on the workers or the cargo and nailguns are extremely dangerous for both the workers and cargo. Unpacking a wooden crate often involves crowbars and hammers to pry apart the sealed wood. This takes a great deal of time as well as being dangerous to workers and cargo.

Once an item is sealed inside a wooden crate, further inspection of the cargo is impractical, and further work on the item, such as paint touch-ups, is likewise impractical, as the item must be unpacked, the shortcomings of which have been addressed.

Wooden crates do not weather well, and cannot be stored outside if reuse is planned. Rain and other environmental forces damage wooden crates, causing weakening and collapse over time. Storage of unused crates is inefficient, as they cannot be broken down into component parts. Since they must be stored inside and at full size, a great deal of space is required for empty crates. Wooden containers often cannot be stacked very high, and cannot be lifted from all four sides, as the crates are often designed in such a way as to make them susceptible to damage if improperly lifted.

These crates often cannot protect their cargo if turned on their side or top.

Wooden crates are also costly to manufacture, both in terms of manpower and in damage to the environment. Forests are leveled to provide the raw materials for crate building, and the crates themselves are not easily recycled. The wood comprising the crate may be infested with pests such as pine beetles, the importation of which can be damaging or prohibited. Many countries will not accept imported good in wooden crates.

Crates manufactured from other materials such as cardboard, fiberboard and metal are known in the art. U.S. Pat. No. 4,852,756 issued to Holladay on Aug. 1, 1989 describes a fiberboard and plywood shipping container for large, bulky objects. Other containers made from corrugated or stamped metal sheeting are known in the art.

These containers suffer from the same shortcomings as wooden crates, and are generally more expensive to fabricate. Metal containers offer greater protection for the cargo, but are generally heavier, which caused more difficulty in storage, transport and crating. Fiberboard and cardboard containers are lighter and easier to transport and store, but generally lack the protective ability and stacking capability of wooden and metal crates.

BRIEF SUMMARY OF THE INVENTION

It is an object of the present invention to provide a metal shipping crate which is easily modifiable to accommodate differing sizes of cargo.

It is a further object of the present invention to provide a metal shipping crate which is easy and safe to pack and unpack, reduces manpower needs for packing and unpacking, is more environmentally safe than the present art, and can be discarded after use or returned to the factory and reused.

It is yet a further object of the present invention to provide a metal shipping crate which can be stored outside and not suffer adversely from exposure to natural forces.

These as well as other objects are accomplished by providing a shipping crate made of tubular metal rails with separate top and bottom portions joined together with an intermediate portion, typically comprising four tubular metal posts. The intermediate portion can be easily adjusted to accommodate cargo of varying height.

DETAILED DESCRIPTION OF THE INVENTION

The present invention provides a modular shipping crate manufactured from tubular steel rails which is easy to pack and unpack, highly modifiable, and sturdy. The present invention also provides a method for utilizing the shipping crate for packing cargo.

The present invention is especially useful for packing large cargo such as ATVs and small personal watercraft, but could be easily modified for other cargo. The design of the present invention is especially suited for ATVs due to its modular design and strength. The steel tubing reduces initial tooling costs, thereby reducing the overall cost of the crate. Other crates can require expensive forming dies and presses, and can only form one size crate. The present invention can be used once and discarded, or broken down into its component parts and returned to the factory for reuse.

Figure 1:
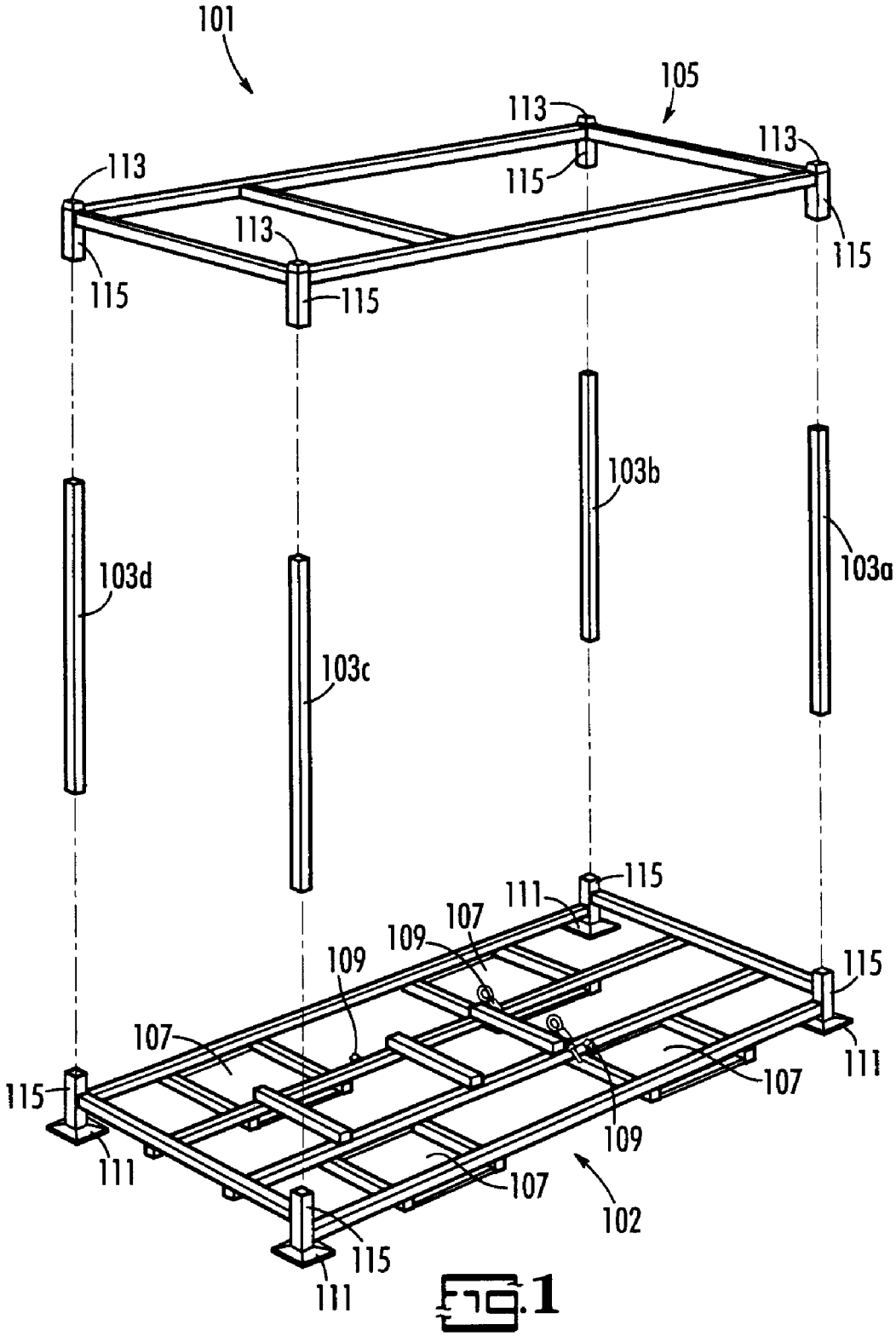
FIG. 1 is an exploded view of the metal shipping crate.

Referring to the drawings, and specifically FIG. 1, the shipping crate 101 is comprised of a bottom portion 102, intermediate portion such as four posts 103*a*–103*d*, and a top portion 105. The bottom portion 102 is comprised of tubular steel rails which are designed for strength and support. The bottom portion 102 is also designed in such a way as to be lifted, such as by a forklift, from any side. In other embodiments, the bottom portion 102 could be telescopically adjustable to accommodate various sizes of cargo. In the present embodiment, the metal tubing can simply be welded to accommodate different cargo.

The present invention requires no predrilled or prepunched holes or bolts to secure the enclosure. This allows inexpensive construction and superior strength, as well as ease of assembly and disassembly, as no tools are required.

The bottom portion 102 generally consists of four outer rails comprising a rectangle, and joined at the corners to a receiving means 115. This receiving means 115 serves as a corner post and also to receive and hold the intermediate portion 103*a*–103*d*. Joined to the receiving means 115 is a receptacle means 111. The receptacle means 111 serves as a base for the corner post and also operates to make stacking the crates more efficient and stable. The bottom portion 102 may include a support for the cargo such as wheel wells 107 or other support, such as for a personal watercraft. These supports may be interchangeable. The bottom portion 102 may further include connecting means 109 which can be adapted to receive bolts. These bolts could be attached to straps or other means which serve to hold the cargo securely to the bottom portion 102. By so securing the cargo, the crate 101 could be turned on its side or top and still protect the cargo.

The intermediate portion 103*a*–103*d* may be comprised of four tubular metal rails which serve as corner posts. The posts engage the receiving means 115 of the bottom portion 102 and are securely held.

The top portion 105 may be comprised of tubular metal rails, and has the same potential for modification as the bottom portion 102. The top portion contains a plurality of receiving means 115 which securely engage with the intermediate portion 103*a*–103*d*. The top portion 105 also has protrusions 113 which, when the crates are stacked, engage with the receptacle means 111 of the bottom portion of the crate above. This engagement serves to stabilize the stack.

Figure 2:
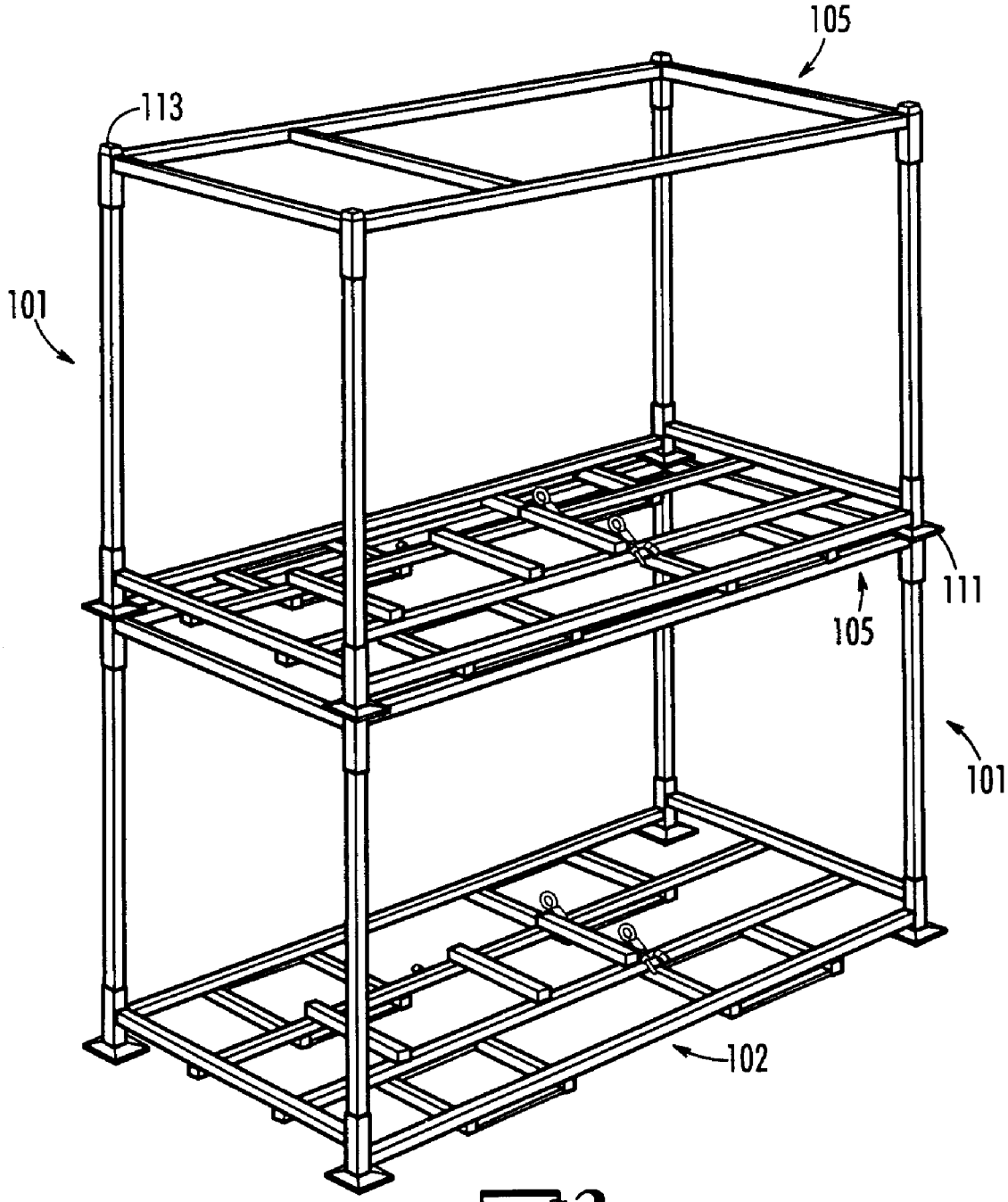
FIG. 2 is a view of two of the metal shipping crates stacked.

FIG. 2 illustrates such a stacking of the present invention. Two crates 101 are stacked in the preferred embodiment, one on top of the other. The protrusions 113 of the top portion 105 of the bottom crate 101 engage with the receptacle means 111 of the bottom portion 102 of the top crate 101. Stacking the crates in this fashion serves to maximize the amount of cargo which can be transported and minimize the amount of space required to store the crated items.

Figure 3:
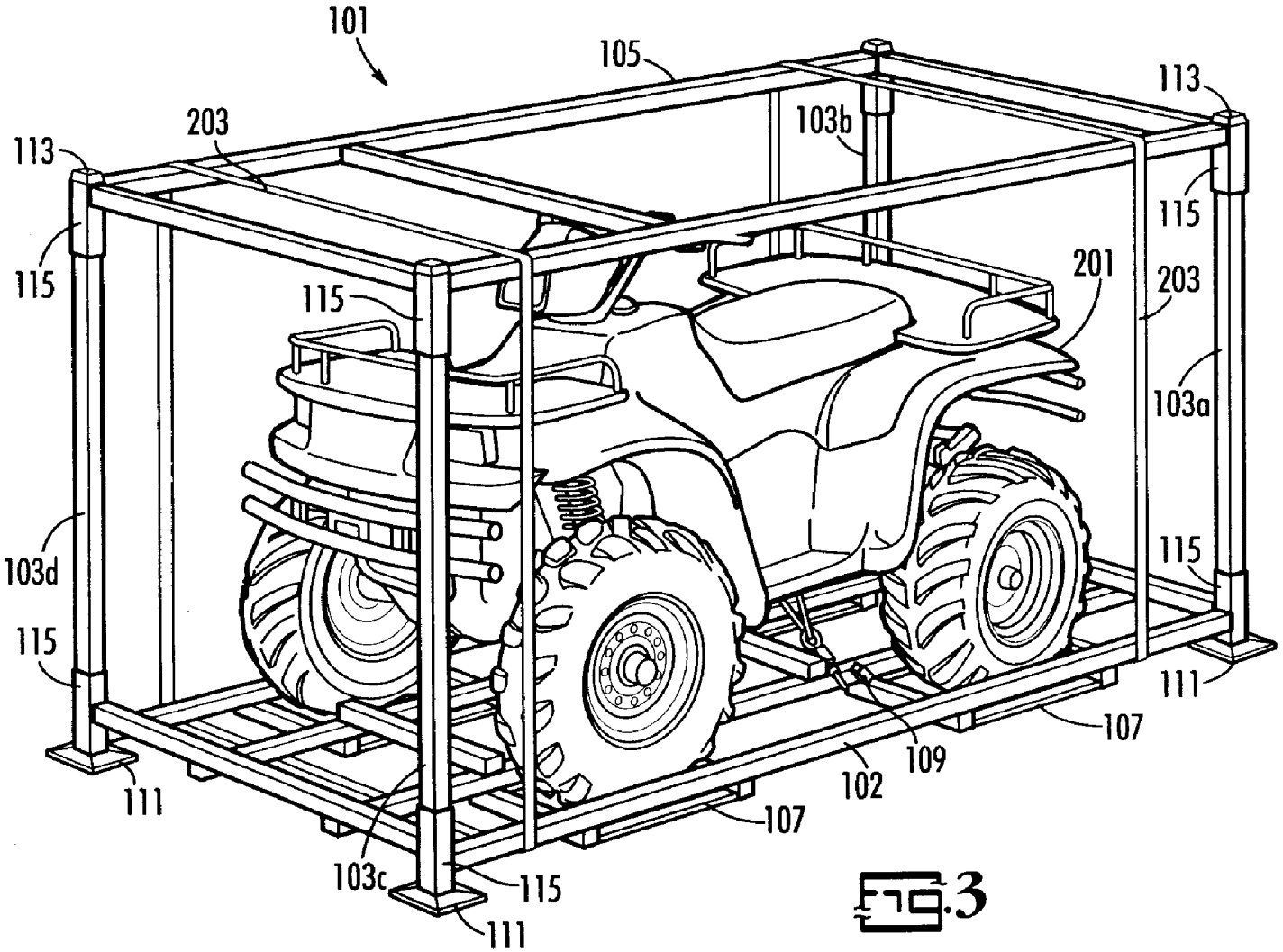
FIG. 3 is a view of the metal shipping crate with sample cargo stored inside.

FIG. 3 illustrates a packed crate. In this embodiment, a four-wheeled ATV is the cargo 201 which has been loaded onto the bottom portion 102 of the crate 101. The cargo 201 rests upon supports 107 of the bottom portion 102, such as wheel wells. The cargo 201 is secured via straps to the connecting means 109 of the bottom portion 102.

The intermediate portion 103*a*–103*d*, which in this embodiment are four tubular metal rails, are inserted into the receiving means 115 of the bottom portion 102. The top portion 105 is them placed such that the receiving means 115 of the top portion 105 engages with the intermediate portion 103*a*–103*d*. Straps 203 may be used to secure the crate 101 so that the top portion 105, intermediate portion 103*a*–103*d*, and bottom portion 102 do not disengage. Other embodiments of the invention can include partial enclosures for one or more sides of the crate when extra protection is needed.

Although the present invention has been described in detail, it should be understood that the method described herein and illustrated in the drawings is subject to other advantages and modifications that may be apparent to those of ordinary skill in the art without departing from the spirit and scope of the appended claims. Accordingly, the invention is to be limited only by the scope of the following claims and their equivalents.

We claim:

1. A shipping crate having a pair of stacked crates, each comprising:

a rectangular top portion having a plurality of receiving means and a plurality of protrusions;

a rectangular bottom portion having a plurality of receiving means and a plurality of receptacle means; and an intermediate portion insertable into said receiving means of said top portion and said bottom portion to form a containment volume therebetween, said containment volume defining a rectangular parallelepiped, said protrusions of said top portion of one of said crates being received by said receptacle means of said bottom portion of the other crate.

2. The shipping crate of claim 1 wherein said top portion, said bottom portion and said intermediate portion are formed from a plurality of tubular metal rails.

3. The shipping crate of claim 1 wherein said intermediate portion comprises segments of varying height to permit a varying height between said top and bottom portions.

4. The shipping crate of claim 1 further including a support attached to said bottom portion.

5. The shipping crate of claim 1 further including support members formed of tubular metal rails attached to said bottom portion and said top portion.

6. The shipping crate of claim 1 further including connecting means fixedly attached to said bottom portion.

7. The shipping crate of claim 1 wherein said top portion, said bottom portion, and said intermediate means are adjustable, such that said shipping crate can accommodate contents of varying size.

8. A shipping crate, comprising:

a rectangular top portion having a plurality of receiving means and a plurality of protrusions;

a rectangular bottom portion having a plurality of receiving means, a plurality of receptacle means, and a plurality of interchangeable supports; and an intermediate portion insertable into said receiving means of said top portion and said bottom portion to form a containment volume therebetween, said containment volume defining a rectangular parallelepiped, said intermediate portion comprising segments of varying height to permit a varying height between said top and bottom portions.

9. The shipping crate of claim 8 wherein said top portion, said bottom portion and said intermediate means are formed of tubular metal rails.

10. The shipping crate of claim 8 further including a plurality of support members comprising tubular metal rails fixedly attached to said top portion and said bottom portion.

11. A method of packaging a manufactured article in a shipping crate, comprising:

providing a shipping crate comprising:

a top portion having a plurality of receiving means and a plurality of protrusions;

a bottom portion having a plurality of receiving means, a plurality of receptacle means, a plurality of connecting means, and a support; and an intermediate portion insertable into said receiving means of said top portion and said bottom portion to form a containment volume therebetween, said containment volume defining a rectangular parallelepiped;

placing article to be crated on said bottom portion;

fastening said manufactured article to said bottom portion;

selecting an intermediate portion of correct height; and assembling selected intermediate portion with said bottom portion and said top portion.

12. The method of claim 11 whereby said manufactured article is oriented onto said support of said bottom portion.

13. The method of claim 11, whereby said manufactured article is fastened to said bottom portion by straps connected to said connecting means of said bottom portion.

14. The method of claim 11, further comprising adjusting the height of said intermediate portion.

15. A shipping crate having a pair of stacked crates, each comprising:

a rectangular top portion having a plurality of receiving means and a plurality of protrusions;

a rectangular bottom portion having a plurality of receiving means and a plurality of receptacle means, and a support; and an intermediate portion insertable into said receiving means of said top portion and said bottom portion to form a containment volume therebetween, said containment volume defining a rectangular parallelepiped, said intermediate portion comprising segments of varying height to permit a varying height between said top and bottom portions, said protrusions of said top portion of one of said crates being received by said receptacle means of said bottom portion of the other crate.

* * * * *